US012467217B2

(12) United States Patent
Kieschnick

(10) Patent No.: US 12,467,217 B2
(45) Date of Patent: Nov. 11, 2025

(54) BOAT DOCK CUSHION APPARATUS

(71) Applicant: Roger Kieschnick, Rockwall, TX (US)

(72) Inventor: Roger Kieschnick, Rockwall, TX (US)

( * ) Notice: Subject to any disclaimer, the term of this patent is extended or adjusted under 35 U.S.C. 154(b) by 699 days.

(21) Appl. No.: 17/857,324

(22) Filed: Jul. 5, 2022

(65) Prior Publication Data

US 2023/0002990 A1 Jan. 5, 2023

Related U.S. Application Data

(60) Provisional application No. 63/217,991, filed on Jul. 2, 2021.

(51) Int. Cl.
*E02B 3/26* (2006.01)
*B63B 59/02* (2006.01)

(52) U.S. Cl.
CPC ..... *E02B 3/26* (2013.01); *B63B 59/02* (2013.01)

(58) Field of Classification Search
CPC ... E02B 3/00; E02B 3/26; A63B 71/00; A63B 71/02; B63B 59/00; B63B 59/02
USPC ..... 114/219; 405/212, 215
See application file for complete search history.

(56) References Cited

U.S. PATENT DOCUMENTS 3,831,941 A * 8/1974 Pease ..... A63B 71/0054 267/116
5,562,364 A * 10/1996 Darder-Alomar ..... E02B 3/26 114/219
6,619,222 B1 * 9/2003 Clary ..... B63B 59/02 114/219
8,979,436 B2 * 3/2015 Goodman ..... E02B 3/26 405/215

* cited by examiner

*Primary Examiner* — Lars A Olson
(74) *Attorney, Agent, or Firm* — Hall Estill Law Firm

(57) ABSTRACT

A method of installing a boat dock cushion apparatus for protecting a boat from damage when a boat contacts structural tubing used on a boat dock. The boat dock cushion apparatus includes a cushion portion for encapsulating at least a portion a tubing's circumference and length. The cushion apparatus also includes an outer layer for covering the cushion apparatus and a portion of the tubing to protect the cushion apparatus from the elements. The cushion apparatus further includes a first support apparatus extending form the outer layer for supporting the cushion portion when the first support apparatus is disposed below the cushion portion.

16 Claims, 9 Drawing Sheets

BOAT DOCK CUSHION APPARATUS

CROSS-REFERENCE TO RELATED APPLICATIONS

The present application is a conversion of U.S. Provisional Application having U.S. Ser. No. 63/217,991, filed Jul. 2, 2021, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a boat dock cushion apparatus for encapsulating at least a portion of a boat dock post to prevent damage to boats entering and departing a slip in a marina.

2. Description of the Related Art

Boat docks are constructed of various materials, which can be hard and easily damage boats that get close to the docks or enter into slips in a marina. Metal tubing is a typical material used for constructing boat docks and slips and is routinely used to construct railing and support members around the slips and docks. Regardless of the level of care boaters take when docking a boat or pulling into a slip, boats are still often damaged in these situations.

Accordingly, there is a need for a boat dock cushion apparatus that can encapsulate at least a portion of a structural tubing of docks or slips to prevent damage to boats approaching a dock or entering and departing a slip a marina.

SUMMARY OF THE DISCLOSURE

The present disclosure is directed to a boat dock cushion apparatus for protecting a boat from damage when a boat contacts structural tubing used on a boat dock. The boat dock cushion apparatus includes a cushion portion for encapsulating at least a portion a tubing's circumference and length. The cushion apparatus also includes an outer layer for covering the cushion apparatus and a portion of the tubing to protect the cushion apparatus from the elements. The cushion apparatus further includes a first support apparatus extending form the outer layer for supporting the cushion portion when the first support apparatus is disposed below the cushion portion. The present disclosure is also directed toward a method of installing a boat dock cushion apparatus on a dock post.

DETAILED DESCRIPTION OF THE DISCLOSURE

Figure 1A:
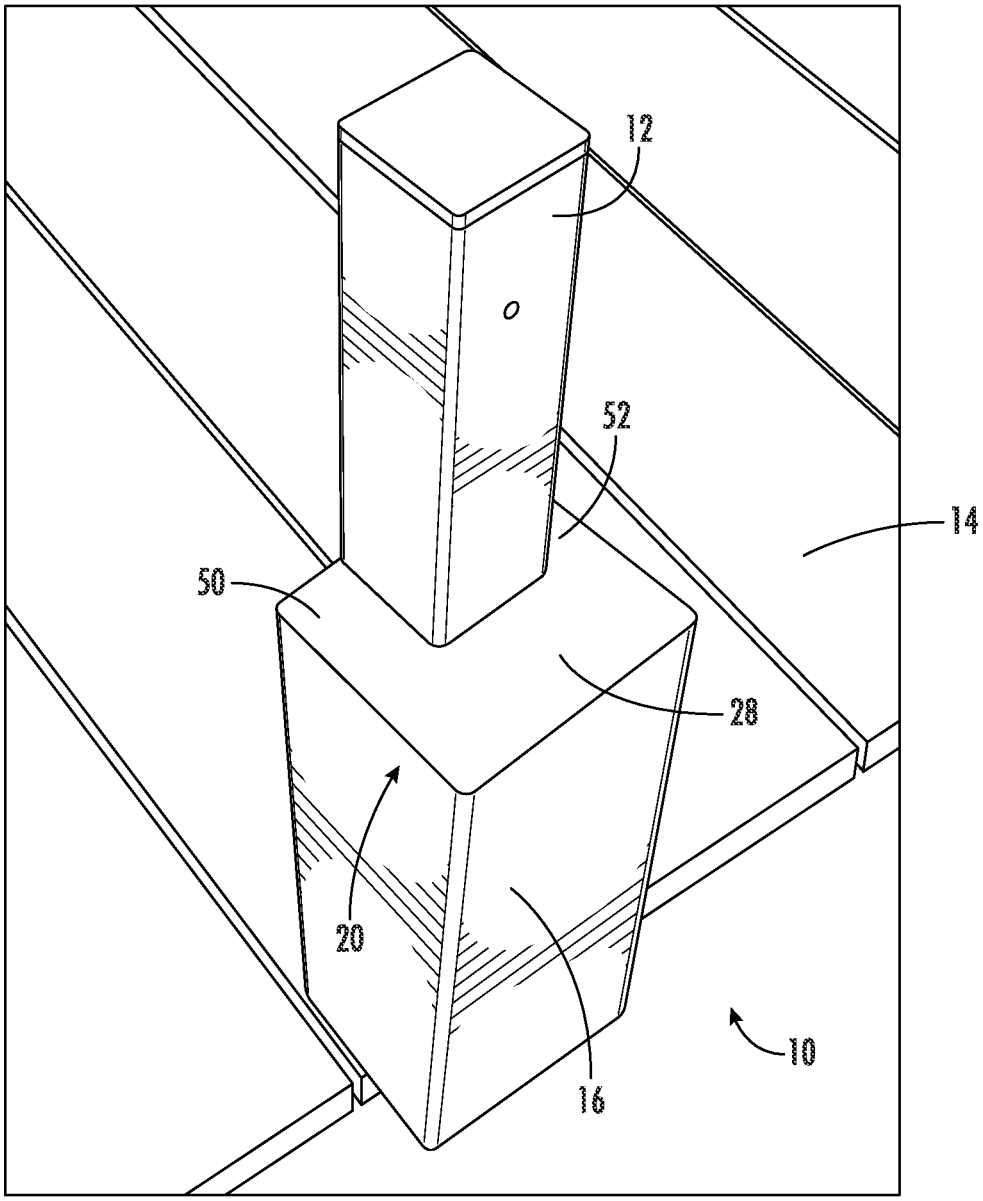
FIGS. 1A and 1B are perspective views of a boat dock cushion apparatus constructed in accordance with the present disclosure.
Figure 1B:
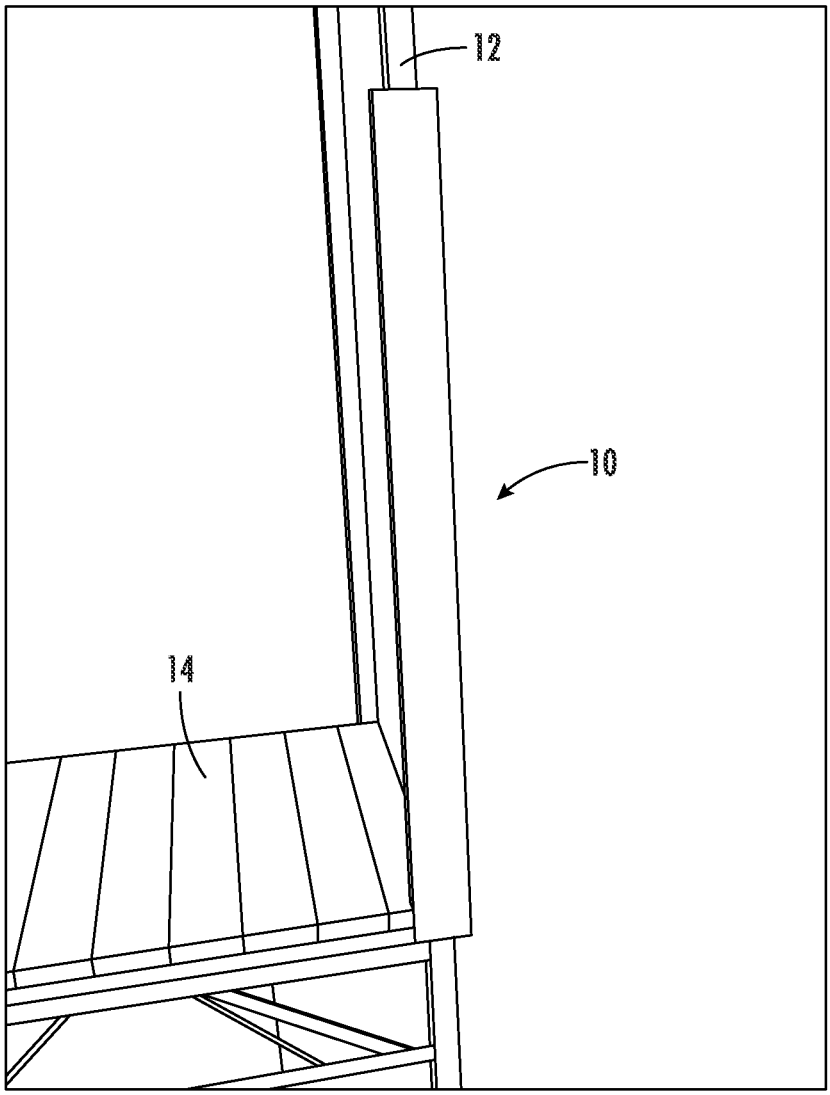
Figure 2A:
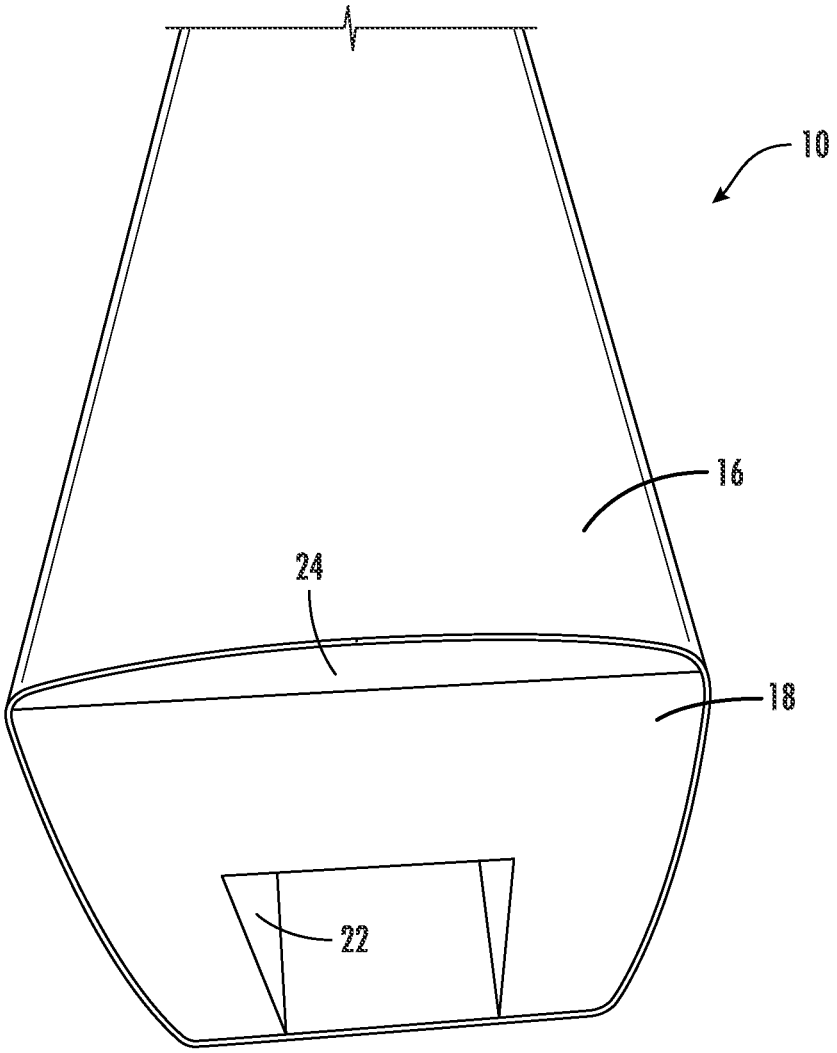
FIGS. 2A and 2B are perspective views of portions of the boat dock cushion apparatus constructed in accordance with the present disclosure
Figure 2B:
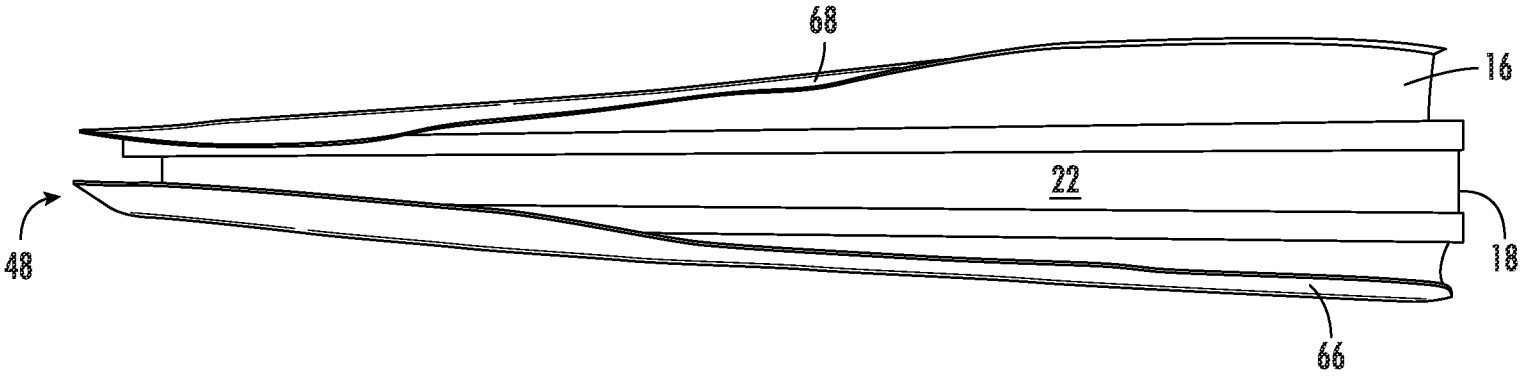
Figure 2C:
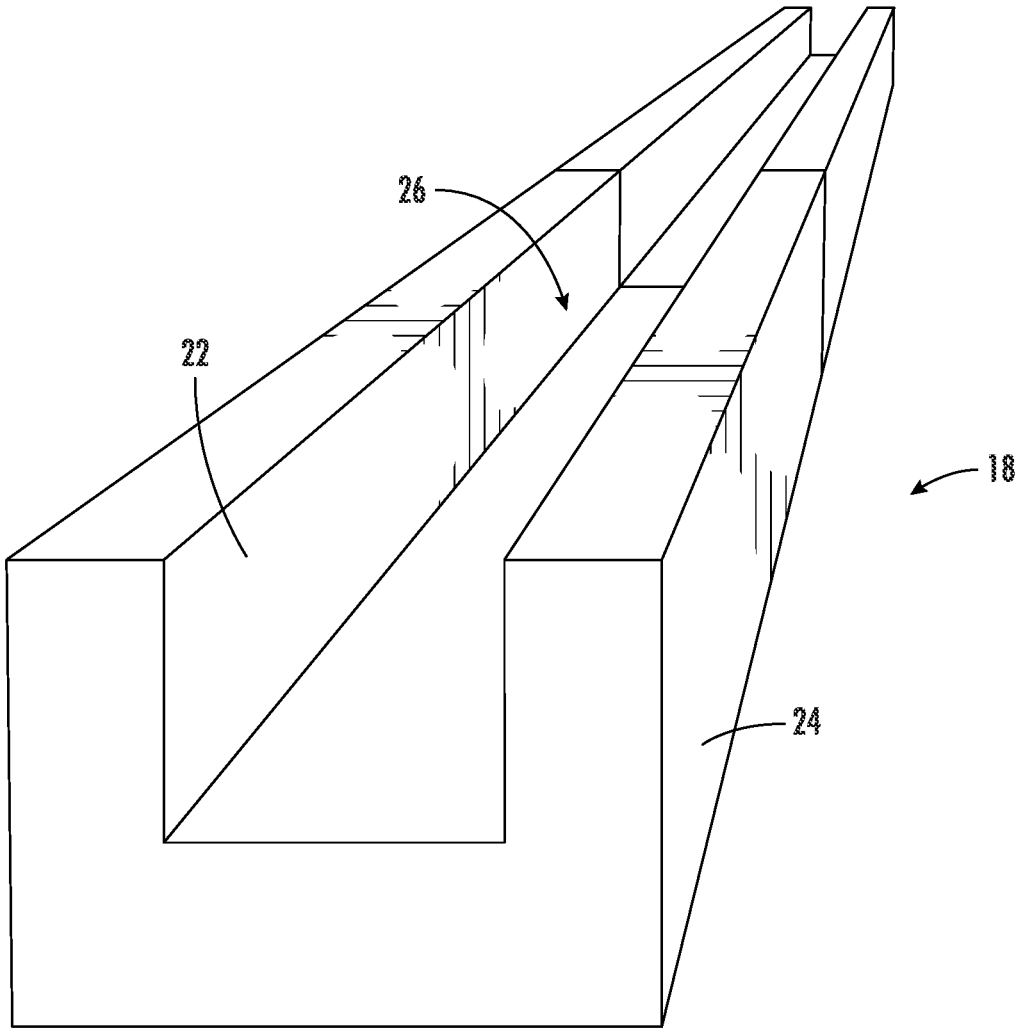
FIG. 2C is a perspective view of a cushion portion of the boat dock cushion apparatus constructed in accordance with the present disclosure.
Figure 3A:
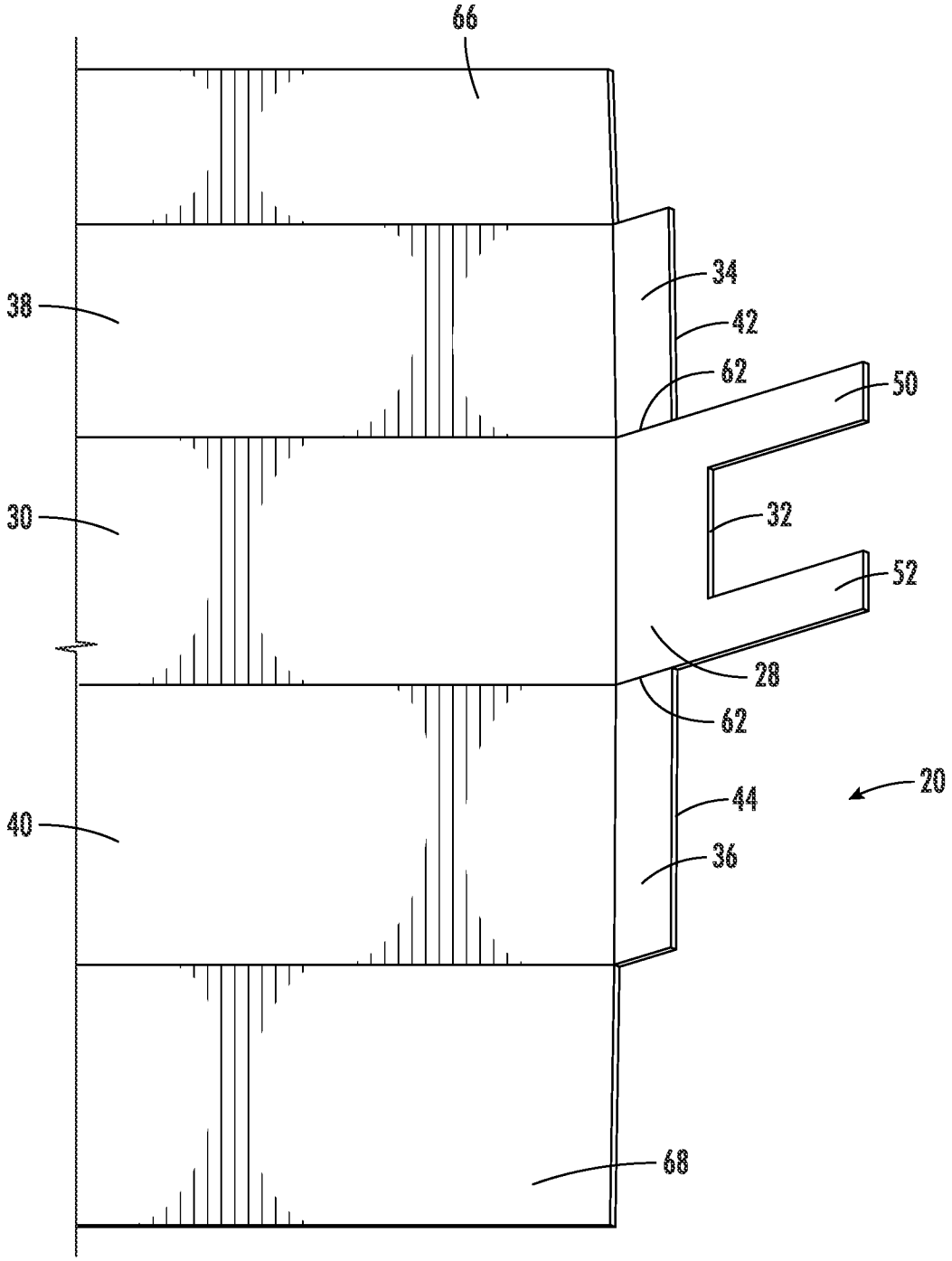
FIGS. 3A and 3B are perspective views of another part of the boat dock cushion apparatus constructed in accordance with the present disclosure.
Figure 3B:
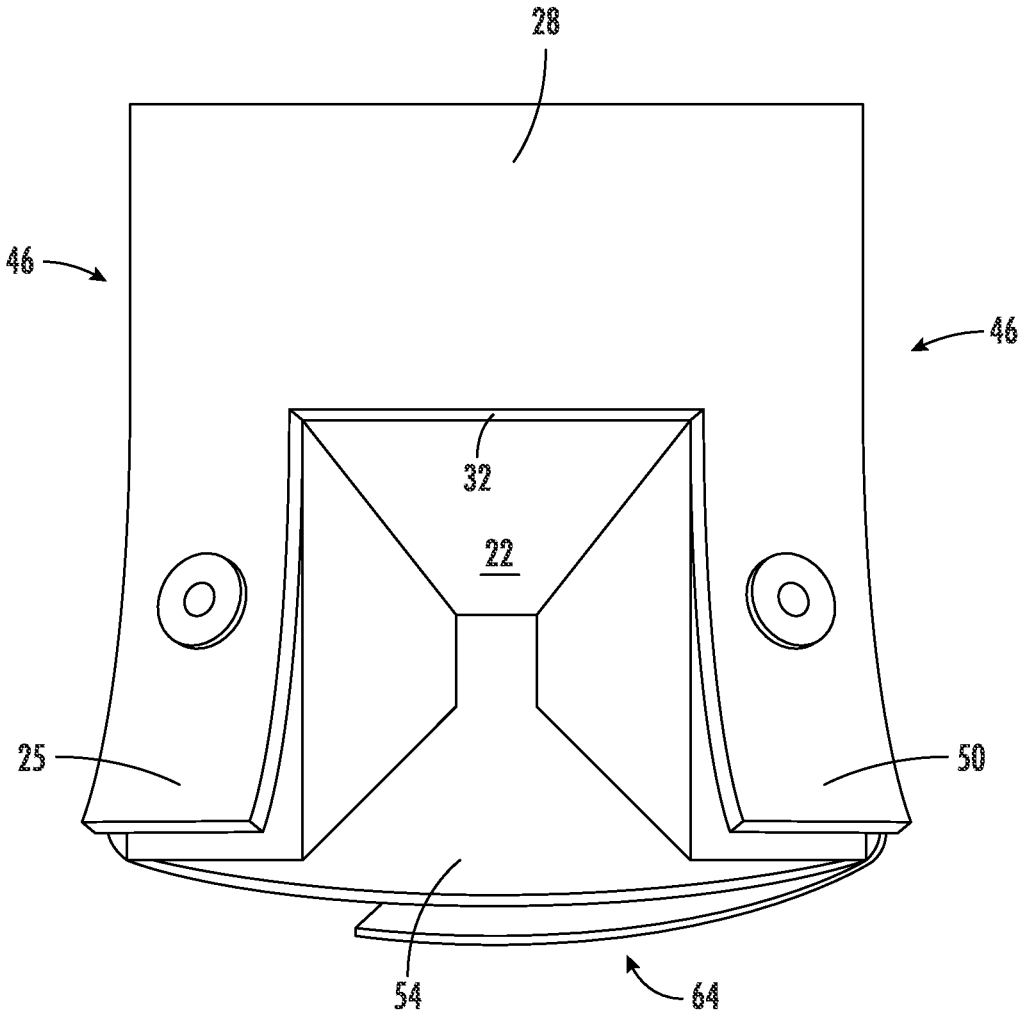
Figure 4A:
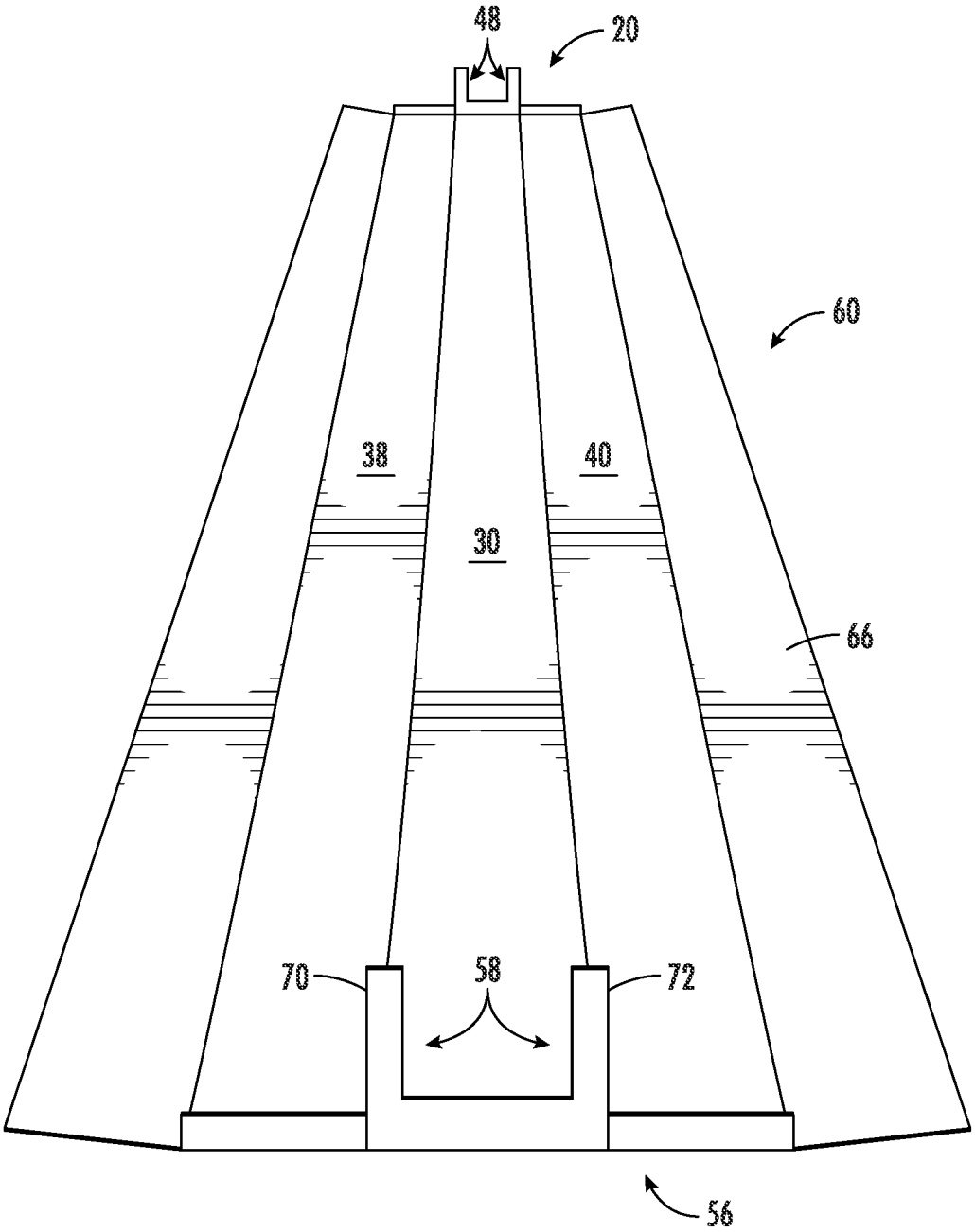
FIGS. 4A and 4B are perspective views of other parts of the boat dock cushion apparatus constructed in accordance with the present disclosure.
Figure 4B:
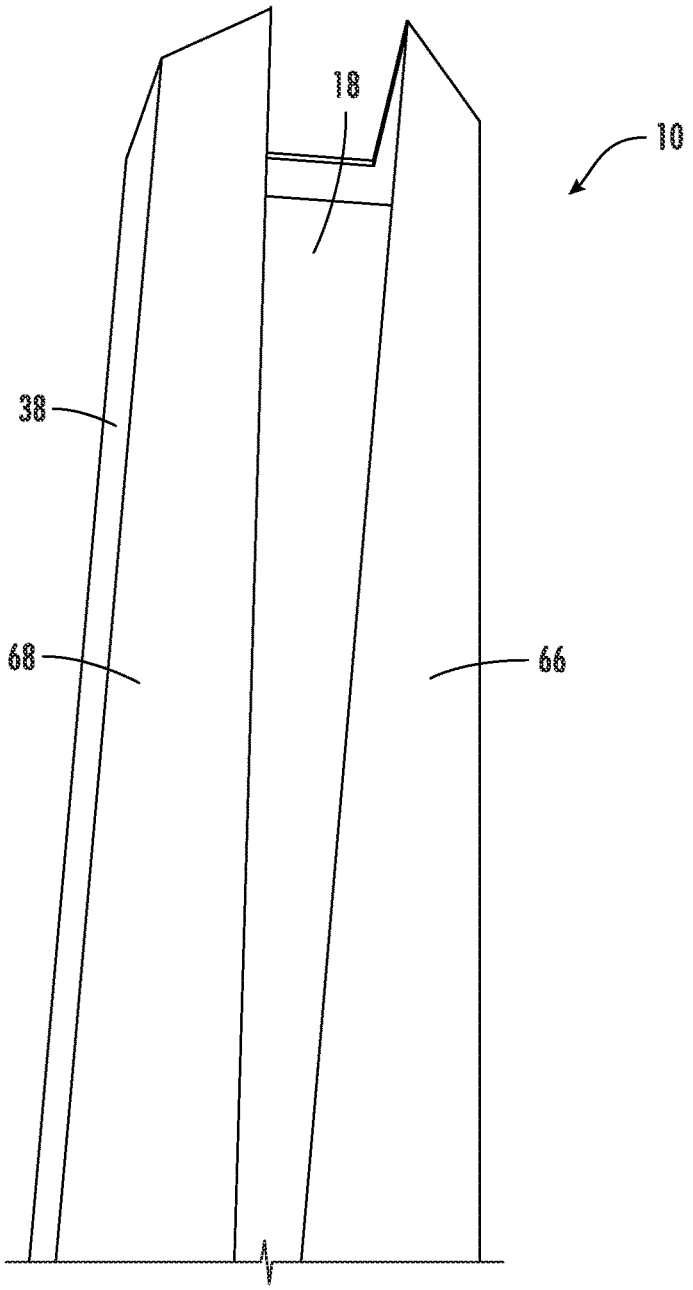

The present disclosure relates to a boat dock cushion apparatus 10 for encapsulating at least a portion of a boat dock or marina slip post 12 (or structural tubing) to prevent damage to boats approaching a dock 14 entering and departing a slip in a marina. The boat dock cushion apparatus 10, shown in FIGS. 1A-4B, includes an outer layer 16 constructed of a material that is flexible and would not damage a boat when contacted by the boat and a cushion portion 18 to prevent damage to a boat in the event forceful contact with the structural tubing 12 were to occur. The outer layer 16 also protects the cushion portion 18 of the boat dock cushion apparatus 10 and provides vertical support of the cushion portion 18.

The cushion portion 18 can have an inner side 22 and an outer side 24. The inner side 22 engages at least a portion of the circumference of the tubing 12 and can be shaped to have a mating engagement with the tubing 12, which can have any shape known in the art such as round, square, etc. The outer side 24 of the cushion portion 18 is designed to have the outer layer 16 be wrapped thereon. In one embodiment, the cushion portion 18 and the outer layer 16 are not attached to each other so that if one of them gets damaged, the damaged part can be replaced without having to replace both parts. In certain situations, the tubing 12 has a quadrilateral cross-section (e.g. rectangular, square, etc.) and the cushion portion 18 has a channel 26 disposed therein that fits the tubing 12 with the quadrilateral cross-section. The cushion portion 18 can have any desired thickness and be constructed of any desirable material to withstand the potential forces applied to the boat dock cushion apparatus 10. It should be understood and appreciated that the inner side 22 of the cushion apparatus 10 can be shaped to fit tubing with any cross-sectional shape, such as round.

The outer layer 16 can have a support apparatus 20 for supporting the cushion portion 18 within at least a part of the outer layer 16. The support apparatus 20 of the outer layer 16 can also be used to cover the cushion apparatus 10 depending on whether the support apparatus 20 is disposed below or above the cushion portion 18. If the support apparatus 20 is disposed above the cushion portion 18 then its primary function is to cover the cushion apparatus 10 and prevent the cushion apparatus 10 from migrating up and out of the outer layer 16. When the support apparatus 20 is disposed below the cushion portion 18, one of its primary functions is to hold the cushion apparatus 10 in place within the outer layer 16 and prevent the cushion apparatus 10 from migrating downward and out of the outer layer 16 of the boat dock cushion apparatus 10.

In one embodiment when the cushion portion 18 surrounds three sides of a tubing 12 with a quadrilateral shaped cross-section, the support apparatus 20 includes a primary ledge portion 28 that extends roughly perpendicular to a first sidewall portion 30 of the outer layer 16 wherein the inside edge 32 of the primary ledge portion 28 can touch, or very closely touch, the tubing 12. The support apparatus 20 can also include a secondary ledge portion 34 and a tertiary ledge portion 36 that extends roughly perpendicular to a second sidewall portion 38 and a third sidewall portion 40 of the outer layer 16, respectively. Similar to the inside edge 32 of the primary ledge portion 28, the inside edges 42 and 44 of the secondary and tertiary ledge portions 34 and 36, respectively, can touch, or very closely touch, the tubing 12. The primary, secondary and tertiary ledge portions 28, 34 and 36 cooperate to provide a ledge 46 that the cushion apparatus 10 can sit on when the support apparatus 20 is disposed below the cushion portion 18. The number of ledge portions 28, 34 and 36 corresponds to the number of sides of the tubing 12 that the cushion portion 18 of the boat dock cushion apparatus 10 extends around.

The boat dock cushion apparatus 10 can also include a securing apparatus 48 that extends from the one of the ledge portions 28, 34 or 36. The securing portion 48 can extend from one of the ledge portions 28, 34 or 36 and engage a part of one of the sidewalls to secure the support apparatus 20 in place and help prevent the cushion portion 18 from moving out from between the sidewalls 30, 38 or 40 of the outer layer 16. The securing apparatus 48 can have a first strap 50 that extends from one of the ledge portions 28, 34 or 36 and engage a part the sidewall 30, 38 or 40 that is on the opposite side of the boat dock cushion apparatus 10 from the ledge portion the first strap 50 extends from. In another embodiment, a second strap 52 extends from the ledge portion 28, 34 or 36 the first strap 50 extends from and engages a part of the same sidewall 30, 38 or 40 that first strap 50 engages. The first or second strap 50 or 52 can be secured to the sidewall 30, 38 or 40 in any manner known in the art, such as via hooks and loops, snap buttons, buttons, brad rivets, etc.

In one embodiment, the first strap 50 extends from the primary ledge portion 28 to a fourth sidewall 54 on one side of the tubing 12 and the second strap 52 extends from the primary ledge portion 28 to the fourth sidewall 54 on the opposite side of the tubing 12 from the first strap 50. The first and second straps 50 and 52 can also extend out just far enough to cover the cushion portion 18 and then be secured directly to the cushion portion 18. It should be understood and appreciated that the boat dock cushion apparatus 10 can include a second support apparatus 56 and a second securing portion 58 for engaging the other end of the cushion apparatus 10.

In another embodiment of the present disclosure, the outer layer 16, the support apparatus 20 and straps 50 and 52 from the securing portion 48 can be part of a single continuous sheet of material 60 that has slits 62 cut in certain parts of the sheet of material 60 to facilitate the creation of the outer layer 16, the support apparatus 20 and the straps 50 and 52 of the securing portion 48. The first, second and third sidewall portions 30, 38 or 40 are also parts of the sheet of material 60. In a further embodiment, the fourth sidewall 54 can include an overlap 64 of a first portion 66 and a second portion 68 of the sheet of material 60. The first and second portions 66 and 68 of the sheet of material 60 used to create the fourth sidewall 54 are secured together in any manner known in the art, such as via hooks and loops, snap buttons, buttons, an adhesive material, thread, etc. The boat dock cushion apparatus 10 can be secured to the tubing 12 via screws through the first and second portions of material that make up the fourth sidewall 54, or in any other manner known in the art. In a further embodiment, the second support apparatus 56 and straps 70 and 72 from the second securing portion 58 can also be included in the sheet of material 60.

The present disclosure is also directed toward a method of installing the boat dock cushion apparatus 10 on tubing 12 (or dock posts). The method can include installing numerous boat dock cushion apparatuses 10 on tubings 12 or dock posts.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A boat dock cushion apparatus for protecting a boat from damage when a boat contacts structural tubing used on a boat dock, the boat dock cushion apparatus comprising:

a cushion portion for encapsulating at least a portion a tubing's circumference and length, an outer layer for covering the cushion apparatus and a portion of the tubing to protect the cushion apparatus from the elements;

a first support apparatus extending form the outer layer for supporting the cushion portion when the first support apparatus is disposed below the cushion portion, the first support apparatus includes a first primary ledge portion to support part of the cushion apparatus, a first secondary ledge portion to support another part of the cushion apparatus and a first tertiary ledge portion to support yet another part of the cushion portion; and a second support apparatus disposed above the cushion apparatus to protect the cushion apparatus and prevent upward movement of the cushion apparatus.

2. The boat dock cushion apparatus of claim 1 wherein the cushion apparatus only extends around about three-fourths of the circumference of the tubing.

3. The boat dock cushion apparatus of claim 2 wherein the tubing has a quadrilateral cross-sectional shape.

4. The boat dock cushion apparatus of claim 1 wherein the second support apparatus includes a second primary ledge portion to cover part of the cushion apparatus, a second ledge portion to cover another part of the cushion apparatus and a second tertiary ledge portion to cover yet another part of the cushion portion.

5. The boat dock cushion apparatus of claim 4 further comprising a first strap and a second strap extending from the first primary ledge portion to secure the first ledge portions in place with respect to the cushion portion.

6. The boat dock cushion apparatus of claim 5 further comprising a third strap and a fourth strap extending from the second primary ledge portion to secure the second ledge portions in place with respect to the cushion portion.

7. The boat dock cushion apparatus of claim 6 wherein the outer layer, the first ledge portions, the second ledge portions and the straps are comprised from a single sheet of material.

8. The boat dock cushion apparatus of claim 1 wherein the outer layer has a first sidewall portion, a second sidewall portion, a third sidewall portion and a fourth sidewall portion.

9. A method of installing a boat dock cushion apparatus on a dock post, the method comprises:

installing a boat dock cushion apparatus on at least one dock post, the boat dock cushion apparatus comprising:

a cushion portion for encapsulating at least a portion a tubing's circumference and length, an outer layer for covering the cushion apparatus and a portion of the tubing to protect the cushion apparatus from the elements;

a first support apparatus extending form the outer layer for supporting the cushion portion when the first support apparatus is disposed below the cushion portion, the first support apparatus includes a first primary ledge portion to support part of the cushion apparatus, a first secondary ledge portion to support another part of the cushion apparatus and a first tertiary ledge portion to support yet another part of the cushion portion; and a second support apparatus disposed above the cushion apparatus to protect the cushion apparatus and prevent upward movement of the cushion apparatus.

10. The method of claim 9 wherein the cushion apparatus only extends around about three-fourths of the circumference of the tubing.

11. The method of claim 10 wherein the tubing has a quadrilateral cross-sectional shape.

12. The method of claim 9 wherein the second support apparatus includes a second primary ledge portion to cover part of the cushion apparatus, a second ledge portion to cover another part of the cushion apparatus and a second tertiary ledge portion to cover yet another part of the cushion portion.

13. The method of claim 12 further comprising a first strap and a second strap extending from the first primary ledge portion to secure the first ledge portions in place with respect to the cushion portion.

14. The method of claim 13 further comprising a third strap and a fourth strap extending from the second primary ledge portion to secure the second ledge portions in place with respect to the cushion portion.

15. The method of claim 14 wherein the outer layer, the first ledge portions, the second ledge portions and the straps are comprised from a single sheet of material.

16. The method of claim 9 wherein the outer layer has a first sidewall portion, a second sidewall portion, a third sidewall portion and a fourth sidewall portion.

* * * * *